US009921514B2

(12) United States Patent
Ikeda

(10) Patent No.: US 9,921,514 B2
(45) Date of Patent: Mar. 20, 2018

(54) IMAGE FORMING APPARATUS FOR REMOVING ADHERED MATTER FROM A CHARGING UNIT

(71) Applicant: CANON KABUSHIKI KAISHA, Tokyo (JP)

(72) Inventor: Takahiro Ikeda, Oyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/273,410

(22) Filed: Sep. 22, 2016

(65) Prior Publication Data

US 2017/0090333 A1 Mar. 30, 2017

(30) Foreign Application Priority Data

Sep. 25, 2015 (JP) ..... 2015-188059

(51) Int. Cl.
*G03G 15/02* (2006.01)

(52) U.S. Cl.
CPC ..... *G03G 15/0266* (2013.01); *G03G 15/0225* (2013.01)

(58) Field of Classification Search
CPC ..... G03G 15/0266; G03G 15/0225; G03G 15/0258
USPC ..... 399/100
See application file for complete search history.

(56) References Cited

U.S. PATENT DOCUMENTS

| | | | | |
|---|---|---|---|---|
| 6,215,967 | B1 * | 4/2001 | Takeda | G03G 15/0225 399/148 |
| 2003/0194249 | A1 * | 10/2003 | Kawamura | G03G 15/0225 399/100 |
| 2004/0223784 | A1 * | 11/2004 | Nakahara | G03G 15/0225 399/129 |
| 2005/0078981 | A1 * | 4/2005 | Ishiyama | G03G 15/0225 399/129 |

FOREIGN PATENT DOCUMENTS

| | | | |
|---|---|---|---|
| JP | 04-371972 | A | 12/1992 |
| JP | 2000-029281 | A | 1/2000 |
| JP | 2002-311692 | A | 10/2002 |
| JP | 2003-280335 | A | 10/2003 |
| JP | 2004-191579 | A | 7/2004 |
| JP | 2007-025353 | A | 2/2007 |
| JP | 2010-072396 | A | 4/2010 |
| JP | 2011-158785 | A | 8/2011 |
| JP | 2011-197420 | A | 10/2011 |
| JP | 2015-138212 | A | 7/2015 |

* cited by examiner

*Primary Examiner* — Sandra Brase
(74) *Attorney, Agent, or Firm* — Canon U.S.A., Inc. IP Division

(57) ABSTRACT

An image forming apparatus includes a detection unit (control unit) configured to detect operation information of the image forming apparatus and a controller (control unit) configured to apply an AC voltage to a charging roller by a charging power source during a non-image-forming operation of the image forming apparatus. The controller is configured to control the duration for which the AC voltage is applied on the basis of the operation information detected by the detection unit.

19 Claims, 8 Drawing Sheets

FIG. 4

| CONTINUOUS TRAVEL DISTANCE a OF PHOTOSENSITIVE DRUM PER INSTANCE | NUMBER OF TIMES | ENVIRONMENT | VERTICAL STREAK |
|---|---|---|---|
| 730 mm | 5 | 15°C/10% | ○ |
| 3650 mm | 5 | 15°C/10% | ○ |
| 7300 mm | 5 | 15°C/10% | × |
| 7300 mm | 10 | 15°C/10% | △ |
| 7300 mm | 20 | 15°C/10% | ○ |
| 730 mm | 0 | 30°C/80% | ○ |

FIG. 8

| PRINT MODE | CONTINUOUS TRAVEL DISTANCE a1 OF PHOTOSENSITIVE DRUM PER INSTANCE | CONTINUOUS TRAVEL DISTANCE a2 OF PHOTOSENSITIVE DRUM PER INSTANCE IN STATE IN WHICH DEVELOPING ROLLER ABUTS AGAINST PHOTOSENSITIVE DRUM | CONVERTED b | NUMBER OF TIMES | VERTICAL STREAK |
|---|---|---|---|---|---|
| MONO COLOR | 7300 mm | 0 mm | 7300 mm | 5 | ○ |
| MONO COLOR | 14600 mm | 0 mm | 14600 mm | 5 | × |
| MONO COLOR | 14600 mm | 0 mm | 14600 mm | 20 | ○ |
| FULL COLOR | 7300 mm | 6200 mm | 13500 mm | 5 | × |
| FULL COLOR | 7300 mm | 6200 mm | 13500 mm | 20 | ○ |

IMAGE FORMING APPARATUS FOR REMOVING ADHERED MATTER FROM A CHARGING UNIT

BACKGROUND OF THE INVENTION

Field of the Invention

Embodiments of the present invention relate to an electrophotographic image forming apparatus, such as a copier, a printer, or a facsimile apparatus.

Description of the Related Art

An image forming apparatus may be constituted by an image forming apparatus main body and a developing cartridge to which a developing device is detachably mounted, or may be constituted by an image forming apparatus main body and a process cartridge in which a developing device, an image bearing member, and other image forming process units are integrated.

A charging roller is widely used as a charging unit that provides a desired potential to an image bearing member. The charging roller is brought into contact with the image bearing member and charges the surface of the image bearing member through a discharge while rotating.

In addition, according to a known technique for removing developer that remains after a developer image formed on an image bearing member is transferred onto a recording material, the developer is removed by causing a cleaning blade to make contact with the image bearing member in the direction counter to the direction in which the image bearing member rotates.

The charging roller that has made contact with the image bearing member may experience a charging failure as toner or an external additive missed by the cleaning blade adheres to the charging roller, and an image of a vertical streak or the like may be generated. Thus, according to Japanese Patent Laid-Open No. 2002-311692, in order to remove dirt that has adhered to a charging roller, the charging bias is switched while an image is not formed, and thus dirt on the charging roller is removed.

According to Japanese Patent Laid-Open No. 04-371972, the number of times the charging bias for removing dirt is applied is changed in accordance with the extent to which a process cartridge has been used.

According to Japanese Patent Laid-Open No. 2003-280335, the control of the charging bias for removing dirt is changed when the cumulative print ratio has exceeded a threshold value set in advance.

According to Japanese Patent Laid-Open No. 2000-029281, the control of the transfer bias for removing dirt on a transfer unit is changed in accordance with the number of successively printed sheets.

However, along with the reduction in the size of the process cartridge in recent years, the diameter of the charging roller is being reduced. Thus, the number of rotations of the charging roller has increased due to the decrease in the diameter of the charging roller, and the frequency at which the charging roller makes contact with an image bearing member has increased, which has led to a situation in which dirt is more likely to accumulate on the charging roller. Furthermore, when images are to be formed successively, adhered matter on the charging roller accumulates.

Therefore, a removing voltage is applied to the charging roller during a non-image-forming operation so as to remove the adhered matter. However, if the control is carried out in accordance with the print ratio of image formation, an external additive of polarity that is opposite to the polarity of the toner is supplied even for a solid white image, and thus the external additive is likely to adhere to the charging roller.

In addition, if the control is carried out in accordance with the number of successively printed sheets, the cleaning blade may miss the toner or the external additive near the cleaning blade, or the removing control may be executed more than necessary.

SUMMARY OF THE INVENTION

The invention is directed, in one aspect, to providing an image forming apparatus that can efficiently remove adhered matter from a charging unit.

In addition, the invention is directed, in another aspect, to providing an image forming apparatus configured to carry out an image forming operation of forming an image on a recording material. The image forming apparatus includes an image bearing member configured to be rotatable, a charging member configured to charge the image bearing member, a voltage application device configured to apply a voltage to the charging member, an image exposure device configured to form an electrostatic latent image on the image bearing member charged by the charging member, a developing device configured to supply developer to the electrostatic latent image formed on the image bearing member by the image exposure device so as to develop the electrostatic latent image into a toner image, a transfer member configured to transfer the toner image formed on the image bearing member by the developing device onto a transfer body, a detection unit configured to detect operation information of the image forming apparatus, and a controller configured to cause the voltage application device to apply an AC voltage to the charging member during a non-image-forming operation of the image forming apparatus. The controller is configured to control a duration for which the AC voltage is applied on the basis of the operation information detected by the detection unit.

Further features of the invention will become apparent from the following description of exemplary embodiments with reference to the attached drawings.

BRIEF DESCRIPTION OF THE DRAWINGS

FIG. 4 illustrates a table summarizing the moving distance of an image bearing member per instance of an adhered matter removing operation, the number of times an AC voltage is turned ON/OFF, the use environment, and the evaluation of a vertical streak according to the first exemplary embodiment.

FIG. 8 illustrates a table summarizing the print mode, the moving distance of an image bearing member per instance of an adhered matter removing operation, the converted moving distance of the image bearing member, the number of times an AC voltage is turned ON/OFF, and the evaluation of a vertical streak according to the third exemplary embodiment.

DESCRIPTION OF THE EMBODIMENTS

An image forming apparatus according to an exemplary embodiment of the invention will be described in concrete terms with reference to the drawings.

First Exemplary Embodiment

First, a configuration of an image forming apparatus according to a first exemplary embodiment of the invention will be described with reference to FIGS. 1 through 4.

Image Forming Apparatus

Figure 1:
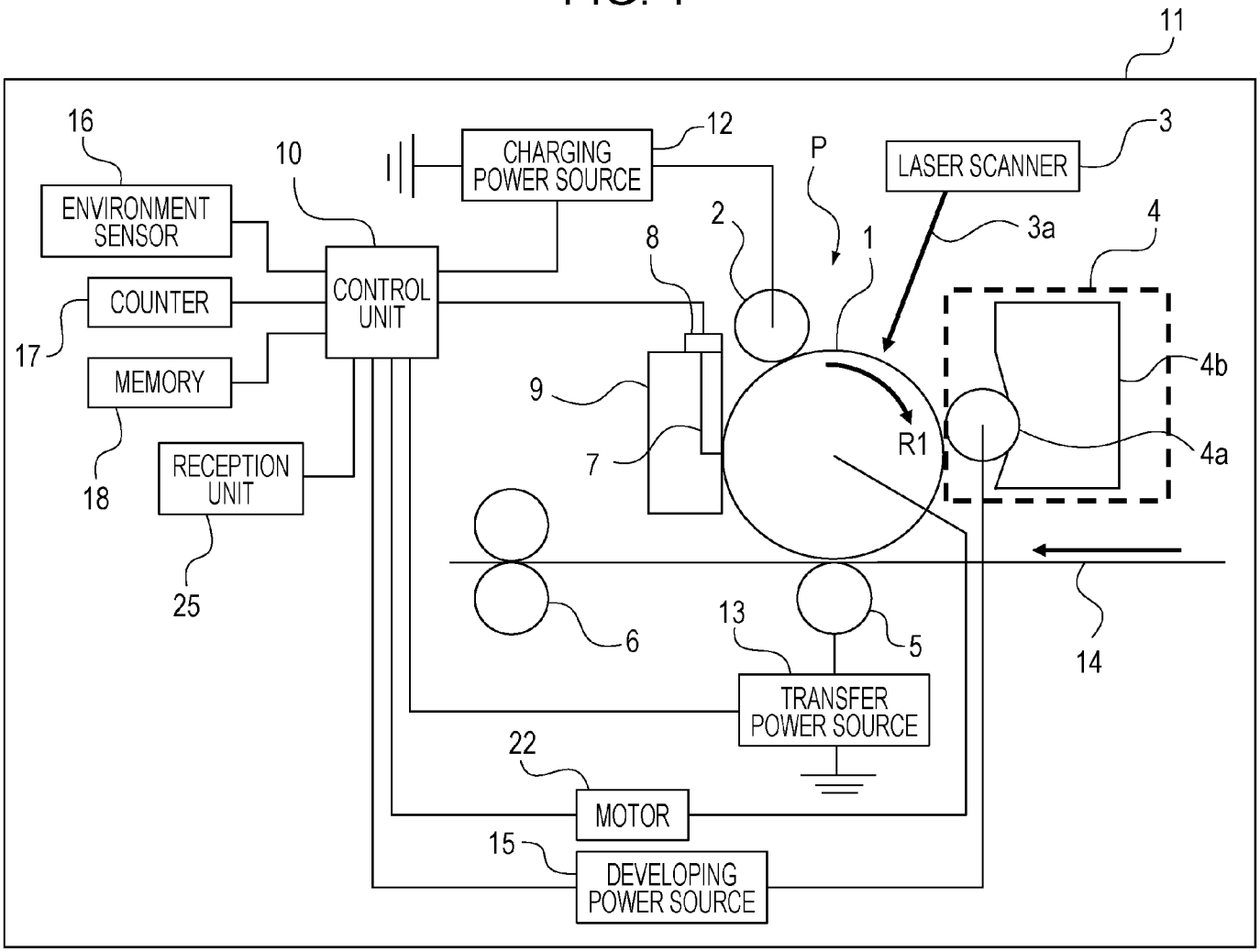
FIG. 1 is a sectional diagram illustrating a configuration of an image forming apparatus according to a first exemplary embodiment of the invention.

An image forming apparatus 11 illustrated in FIG. 1 includes a process cartridge P that is detachably mounted to the main body of the image forming apparatus 11. The image forming apparatus 11 rotationally drives a photosensitive drum 1, which serves as a rotatable image bearing member, in the direction indicated by the arrow R1 in FIG. 1, upon receiving a command for forming an image. The image forming apparatus 11 carries out a pre-rotation operation that is a preparation for forming an image, an image forming operation of forming an image, and a post-rotation operation that is carried out after forming an image, and then stops the rotational driving of the photosensitive drum 1. The pre-rotation operation and the post-rotation operation are operations in which an image is not formed and are thus referred to as a non-image-forming operation.

Image Forming Operation

Next, the image forming operation of the image forming apparatus 11 will be described with reference to FIG. 1. With reference to FIG. 1, the photosensitive drum 1 is rotationally driven by a motor 22, which serves as a driving source, provided in the main body of the image forming apparatus 11 and thus rotates in the direction indicated by the arrow R1 in FIG. 1.

A charging roller 2, which serves as a charging member, makes contact with the surface of the photosensitive drum 1, rotates so as to follow the surface, and charges the surface of the photosensitive drum 1. A charging power source 12, which serves as a voltage application device, applies a charging voltage to the charging roller 2. A DC voltage of negative polarity is applied to the charging roller 2 from the charging power source 12 so as to cause the charging roller 2 to discharge toward the surface of the photosensitive drum 1. Thus, a uniform potential is provided to the surface of the photosensitive drum 1.

The surface of the photosensitive drum 1 that has been charged uniformly by the charging roller 2 is irradiated with a laser beam 3*a* emitted by a laser scanner 3, which serves as an image exposure device, in accordance with image information, and thus an electrostatic latent image is formed on the surface of the photosensitive drum 1.

A developing device 4 is provided, and the developing device 4 serves as a developing device that supplies developer (toner) to an electrostatic latent image formed on the surface of the photosensitive drum 1 by the laser scanner 3 so as to develop the electrostatic latent image into a toner image.

The developing device 4 includes a developer container 4*b* that stores magnetic mono-component toner of negative chargeability and a developing sleeve 4*a*, which serves as a developing member that functions as a rotatable developer bearing member. The developing device 4 causes a developing blade (not illustrated) to make contact with the surface of the developing sleeve 4*a* so as to provide a charge to the toner held on the surface of the developing sleeve 4*a*.

The toner is composed of a host member made of resin particles containing magnetic matter and an external additive, such as silica or inorganic fine particles of positive chargeability.

A developing power source 15 illustrated in FIG. 1 superimposes an AC voltage on a DC voltage of negative polarity and applies the resulting voltage to the developing sleeve 4*a* of the developing device 4. Thus, the toner held on the surface of the developing sleeve 4*a* is supplied to the electrostatic latent image formed on the surface of the photosensitive drum 1, and the electrostatic latent image is developed into a toner image.

A transfer roller 5 is provided so as to oppose the photosensitive drum 1, and the transfer roller 5 serves as a transfer member that transfers the toner image formed on the surface of the photosensitive drum 1 by the developing device 4 onto a recording material 14, which serves as a transfer body.

A transfer power source 13 applies a transfer voltage composed of a DC voltage of positive polarity to the transfer roller 5. Thus, the toner image formed on the surface of the photosensitive drum 1 is transferred onto the recording material 14. The unfixed toner image transferred to the recording material 14 is heated and pressurized in a process of being pinched and conveyed by a fixing roller and a pressure roller provided in a fixing device 6, which serves as a fixing unit, and the toner is thermally melted. Thus, the unfixed toner image is thermally fixed to the surface of the recording material 14.

The residual toner that remains on the surface of the photosensitive drum 1 after the transfer is scraped by a cleaning blade 7 provided in a cleaning device 9, which serves as a cleaning unit, and is thus removed.

In the exemplary embodiment, the charging voltage of the surface of the photosensitive drum 1 before the surface is charged uniformly by the charging roller 2 at the time of normal image formation is set to −1100 V. The charging potential of the photosensitive drum 1 after the surface is charged uniformly by the charging roller 2 at the time of normal image formation is set to −550 V.

In addition, the charging potential of the surface of the photosensitive drum 1 after the laser beam 3*a* corresponding to the image information is emitted by the laser scanner 3 and the surface of the photosensitive drum 1 charged uniformly by the charging roller 2 is irradiated and exposed with the laser beam 3*a* is set to −200 V.

Furthermore, the DC voltage that serves as a developing voltage applied to the developing sleeve 4*a* of the developing device 4 from the developing power source 15 is set to −400 V.

The cleaning device 9 is provided with a storage device 8, and the storage device 8 serves as a storage unit that stores use history information of the process cartridge P. A control unit 10, which serves as a controller, is provided in the main body of the image forming apparatus 11 and operates in the following manner.

The control unit 10 writes the use history information into the storage device 8 provided on the cleaning device 9 of the process cartridge P that is mounted to the main body of the image forming apparatus 11, or reads out and refers to the use history information stored in the storage device 8.

The main body of the image forming apparatus 11 is provided with an environment sensor 16, and the environment sensor 16 serves as an environment detection unit that detects the temperature and the humidity as use environment information of an environment in which the image forming apparatus 11 is used. The control unit 10 acquires the use environment information of the image forming apparatus 11 detected by the environment sensor 16.

The image forming apparatus 11 according to the exemplary embodiment operates in the following manner during a period corresponding to an interval between a preceding recording material 14 and another recording material 14 immediately following the preceding recording material 14 in continuous printing. Only the charging voltage is applied to the charging roller 2 from the charging power source 12, and the developing voltage is not applied to the developing sleeve 4*a* of the developing device 4 from the developing power source 15.

Adhered Matter Removing Operation of Charging Unit

In the image forming apparatus 11 according to the present exemplary embodiment, the operation of removing adhered matter that has adhered to the surface of the charging roller 2 is carried out during the post-rotation after the image forming operation is finished. In the post-rotation, a main motor of an image forming process unit continues to be driven for a predetermined period of time after a final recording material 14 on which an image has been formed in a continuous print job is output. Thus, an operation after a print job is carried out in each image forming process unit.

Figure 2:
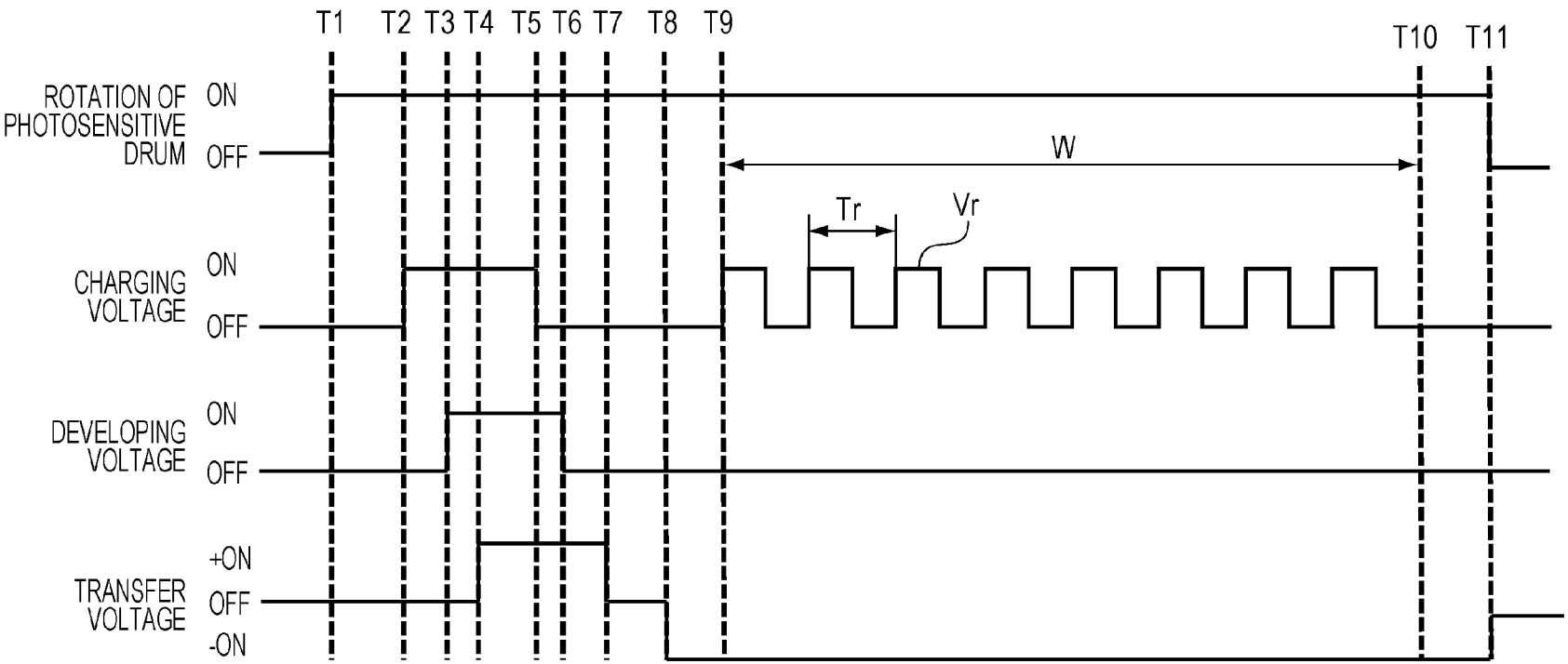
FIG. 2 is a timing chart illustrating an image formation operation according to the first exemplary embodiment.

Next, a process covering from the image forming operation of the image forming apparatus 11 to the operation of removing the adhered matter that has adhered to the surface of the charging roller 2 will be described with reference to FIG. 2. FIG. 2 is a timing chart illustrating the image formation operation according to the exemplary embodiment. As illustrated in FIG. 2, a command signal of a print job is transmitted to a reception unit 25 of the image forming apparatus 11. Then, the control unit 10 rotationally drives the motor 22, which serves as the driving source. Thus, the photosensitive drum 1 starts being rotationally driven in the direction indicated by the arrow R1 in FIG. 1 (time T1).

Next, at a time T2, the control unit 10 applies the charging voltage to the charging roller 2 from the charging power source 12. Thereafter, the surface of the photosensitive drum 1 charged uniformly by the charging roller 2 is irradiated with the laser beam 3*a* emitted by the laser scanner 3 in accordance with the image information, and an electrostatic latent image is formed on the surface of the photosensitive drum 1.

Then, at a time T3, the control unit 10 applies the developing voltage to the developing sleeve 4*a* of the developing device 4 from the developing power source 15. Thus, the toner is supplied to the electrostatic latent image formed on the surface of the photosensitive drum 1, and the electrostatic latent image is developed into a toner image.

Thereafter, at a time T4, the control unit 10 applies the transfer voltage to the transfer roller 5 from the transfer power source 13. Thus, the toner image formed on the surface of the photosensitive drum 1 is transferred onto the recording material 14.

When the series of image forming operations is finished, at a time T5, the control unit 10 stops the charging voltage that is applied to the charging roller 2 from the charging power source 12. Thereafter, at a time T6, the control unit 10 stops the developing voltage that is applied to the developing sleeve 4*a* of the developing device 4 from the developing power source 15. Then, at a time T7, the control unit 10 stops the transfer voltage that is applied to the transfer roller 5 from the transfer power source 13.

Thereafter, at a time T8, the control unit 10 starts the post-rotation operation after image formation. At this point, the control unit 10 applies the transfer voltage of −1100 V to the transfer roller 5 from the transfer power source 13 so as to set the surface potential of the photosensitive drum 1 to −550 V.

Thereafter, at a time T9, the control unit 10 applies a cleaning voltage Vr to the charging roller 2 from the charging power source 12 during the non-image-forming operation of the image forming apparatus 11, as indicated by an adhered matter removing operation segment W illustrated in FIG. 2. The cleaning voltage Vr applied at this point is a pulsed AC voltage that repeats ON/OFF with a predetermined cycle Tr. The control unit 10 applies the cleaning voltage Vr while controlling the number of the cycles Tr of the cleaning voltage Vr. Thus, the adhered matter that has adhered to the surface of the charging roller 2 can be removed.

The cleaning voltage Vr composed of a pulsed AC voltage that repeats ON/OFF continues to be applied to the charging roller 2 from the charging power source 12 until a time T10. The duration from the time T9 to the time T10 illustrated in FIG. 2 corresponds to the adhered matter removing operation segment W in which the adhered matter that has adhered to the surface of the charging roller 2 is removed.

Here, one cycle Tr of the cleaning voltage Vr composed of the pulsed AC voltage that repeats ON/OFF and applied to the charging roller 2 from the charging power source 12 corresponds to a single instance of the adhered matter removing operation.

Thereafter, at a time T11, the control unit 10 stops the rotational operation of the photosensitive drum 1. In the adhered matter removing operation segment W illustrated in FIG. 2, the charging voltage of −1100 V is applied to the charging roller 2 from the charging power source 12 during a period in which the cleaning voltage Vr to be applied to the charging roller 2 from the charging power source 12 is ON. Meanwhile, the charging voltage is not applied (0 V) to the charging roller 2 from the charging power source 12 during a period in which the cleaning voltage Vr to be applied to the charging roller 2 from the charging power source 12 is OFF.

In the adhered matter removing operation segment W illustrated in FIG. 2, during a period in which the cleaning voltage Vr to be applied to the charging roller 2 from the charging power source 12 is OFF, the adhered matter of positive polarity that has adhered to the surface of the charging roller 2 can be moved to the surface of the photosensitive drum 1 due to a potential difference between the surface potential of the photosensitive drum 1 and the surface potential of the charging roller 2.

In the adhered matter removing operation segment W illustrated in FIG. 2, during a period in which the cleaning voltage Vr to be applied to the charging roller 2 from the charging power source 12 is ON, the adhered matter of negative polarity that has adhered to the surface of the charging roller 2 can be moved to the surface of the photosensitive drum 1 due to a potential difference between the surface potential of the photosensitive drum 1 and the surface potential of the charging roller 2.

The adhered matter that has adhered to the surface of the charging roller 2 is as follows. There is some toner, an external additive, or the like that has not been scraped and has been missed by the cleaning blade 7 that is disposed upstream from the charging roller 2 in the direction in which the photosensitive drum 1 rotates as indicated by the arrow R1 in FIG. 1. Such toner, external additive, or the like moves from the surface of the photosensitive drum 1 to the surface of the charging roller 2 and adheres thereto, which results in the adhered matter.

Thus, the toner, the external additive, or the like on the surface of the photosensitive drum 1 that has been missed by the cleaning blade 7 may accumulate in proportion to the continuous travel distance a of the outer peripheral surface of the photosensitive drum 1, which serves as the moving distance of the surface of the rotating image bearing member.

It is to be noted that the continuous travel distance a of the outer peripheral surface of the photosensitive drum 1 is measured on the basis of a given point on the outer peripheral surface of the photosensitive drum 1. The continuous travel distance a is the moving distance that indicates how far the given point has moved as the photosensitive drum 1 rotates. Therefore, the continuous travel distance a of the outer peripheral surface of the photosensitive drum 1 is a value proportional to the cumulative number of rotations of the photosensitive drum 1.

Thus, the control unit 10 according to the exemplary embodiment determines the degree of accumulation of the adhered matter that has adhered to the surface of the charging roller 2 on the basis of the continuous travel distance a of the outer peripheral surface of the photosensitive drum 1 and carries out the control in the adhered matter removing operation accordingly. The control unit 10 according to the exemplary embodiment determines the continuous travel distance a of the outer peripheral surface of the photosensitive drum 1 on the basis of the number of successively printed sheets of the recording material 14. In other words, the continuous travel distance is the travel distance of the outer peripheral surface of the photosensitive drum 1 in a period from the time when an image starts being formed upon the reception unit 25 receiving a print command to the time when the post-rotation is carried out upon the image having been formed. In a case in which the reception unit 25 receives a subsequent print job while an image is being formed on the basis of a preceding print job, these print jobs are processed successively. In a case in which the reception unit 25 receives no subsequent print job while an image is being formed on the basis of a preceding print job, the post-rotation is started upon the image that is based on the preceding print job having been formed.

Operation Detection Unit

The control unit 10 according to the exemplary embodiment also functions as an operation detection unit (detection unit) configured to detect operation information of the image forming apparatus 11. The following control is carried out after the image forming operation of the image forming apparatus 11 is finished on the basis of the operation information detected by the control unit 10, which also functions as the operation detection unit. The duration for which the cleaning voltage Vr composed of an AC voltage having the predetermined cycle Tr indicated in the adhered matter removing operation segment W in FIG. 2 is applied to the charging roller 2 from the charging power source 12 during the non-image-forming operation of the image forming apparatus 11 is controlled. In other words, the number of cycles of the AC voltage to be applied (the number of the cycles Tr) is controlled.

The control unit 10, which also functions as the operation detection unit, detects, as the operation information of the image forming apparatus 11, the continuous travel distance a, which is the information related to the continuous travel distance a (the moving distance of the rotating image bearing member) of the outer peripheral surface of the photosensitive drum 1 that rotates in the direction indicated by the arrow R1 in FIG. 1, or a value that is proportional to the continuous travel distance a.

The adhered matter removing operation according to the present exemplary embodiment is carried out during the post-rotation operation after an image is formed by the image forming apparatus 11. When the duration for which the image forming operation is carried out before the post-rotation is long, the time in which the adhered matter accumulates on the surface of the charging roller 2 increases accordingly.

Therefore, according to the present exemplary embodiment, the continuous travel distance a of the outer peripheral surface of the photosensitive drum 1 starts being counted by a counter 17, which serves as a counting unit, upon the image forming apparatus 11 receiving a print command.

In the exemplary embodiment, a predetermined threshold value A (e.g., 7000 mm) is set for the continuous travel distance a of the outer peripheral surface of the photosensitive drum 1. Thus, the number of the cycles Tr of the cleaning voltage Vr composed of the AC voltage having the predetermined cycle Tr indicated in the adhered matter removing operation segment W in FIG. 2 is controlled in accordance with the continuous travel distance a of the outer peripheral surface of the photosensitive drum 1.

Figure 3:
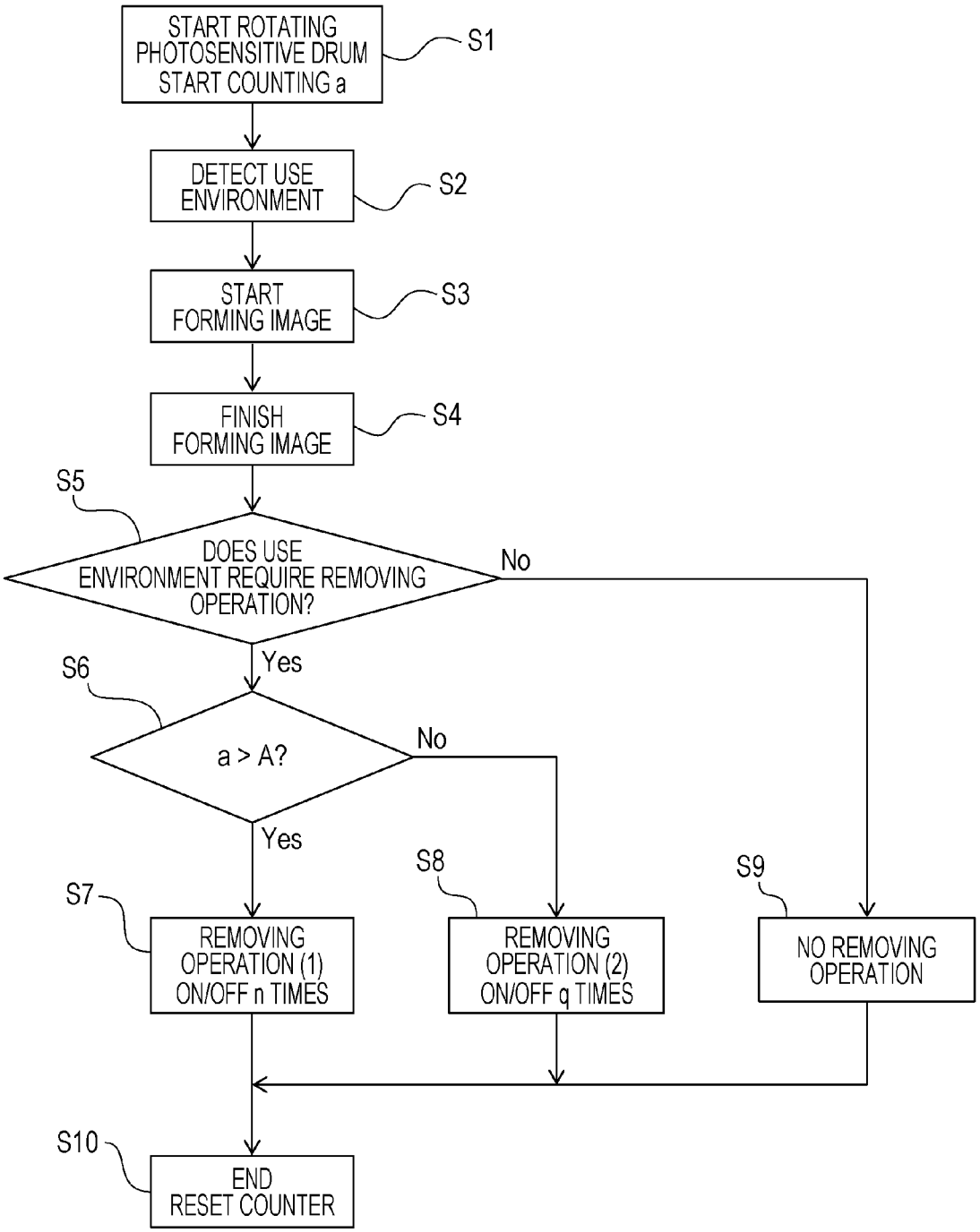
FIG. 3 is a flowchart illustrating an operation of removing adhered matter that has adhered to a charging unit according to the first exemplary embodiment.

Next, the operation of removing the adhered matter that has adhered to the surface of the charging roller 2 will be described with reference to FIG. 3. FIG. 3 is a flowchart for describing the operation of removing the adhered matter that has adhered to the surface of the charging roller 2. In step S1 of FIG. 3, the control unit 10 starts rotationally driving the photosensitive drum 1, upon a print command signal being transmitted to the image forming apparatus 11.

At the same time, the counter 17 starts counting the continuous travel distance a of the outer peripheral surface of the photosensitive drum 1. The continuous travel distance a of the outer peripheral surface of the photosensitive drum 1 continuously counted by the counter 17 is stored into a memory 18, which serves as a storage unit.

In step S2, the control unit 10 acquires the use environment information of the image forming apparatus 11 on the basis of the detection result of the environment sensor 16.

Then, the image forming operation is started in step S3, and the image forming operation is finished in step S4. In step S5, the control unit 10 carries out the following control on the basis of the use environment information of the image forming apparatus 11 detected by the environment sensor 16.

The control unit 10 determines whether the cleaning voltage Vr composed of the AC voltage having the predetermined cycle Tr indicated in the adhered matter removing operation segment W in FIG. 2 is to be applied to the charging roller 2 from the charging power source 12. In other words, the control unit 10 determines whether the operation of removing the adhered matter that has adhered to the surface of the charging roller 2 is to be carried out.

If the control unit 10 determines in step S5 that the operation of removing the adhered matter that has adhered to the surface of the charging roller 2 needs to be carried out on the basis of the use environment information of the image forming apparatus 11 detected by the environment sensor 16, the control unit 10 proceeds to step S6.

In the exemplary embodiment, the control unit 10 carries out the following control in a case in which the use environment information of the image forming apparatus 11 detected by the environment sensor 16 indicates a high-temperature high-humidity environmental condition in which the temperature is 27° C. or higher and the humidity is 70% or higher. The control unit 10 controls so as to refrain from carrying out the operation of removing the adhered matter that has adhered to the surface of the charging roller 2.

In step S6, the control unit 10 determines whether the continuous travel distance a of the outer peripheral surface of the photosensitive drum 1 counted by the counter 17 exceeds the threshold value A (e.g., 7000 mm) set in advance.

With regard to the continuous travel distance a of the outer peripheral surface of the photosensitive drum 1, the continuous travel distance a of the outer peripheral surface of the photosensitive drum 1 counted by the counter 17 at the time when the image forming operation has finished in step S4 is considered.

The control unit 10 makes a determination on the basis of the continuous travel distance a of the outer peripheral surface by which the photosensitive drum 1 has actually rotated. If the continuous travel distance a of the outer peripheral surface of the photosensitive drum 1 exceeds the threshold value A, the control unit 10 proceeds to step S7 and carries out an adhered matter removing operation (1).

In the adhered matter removing operation (1) in step S7, ON/OFF of the cleaning voltage Vr composed of the pulsed AC voltage to be applied to the charging roller 2 from the charging power source 12 in the adhered matter removing operation segment W indicated in FIG. 2 is repeated n times (e.g., 20 times).

Thereafter, in step S10, the adhered matter removing operation (1) is finished, and the continuous travel distance a of the outer peripheral surface of the photosensitive drum 1 stored in the memory 18, which serves as the storage unit, is deleted (reset).

If the continuous travel distance a of the outer peripheral surface of the photosensitive drum 1 is no greater than the threshold value A in step S6, the control unit 10 proceeds to step S8 and carries out an adhered matter removing operation (2). In the adhered matter removing operation (2) in step S8, ON/OFF of the cleaning voltage Vr composed of the pulsed AC voltage to be applied to the charging roller 2 from the charging power source 12 in the adhered matter removing operation segment W indicated in FIG. 2 is repeated q times (e.g., five times; q<n).

Thereafter, in step S10, the adhered matter removing operation (2) is finished, and the continuous travel distance a of the outer peripheral surface of the photosensitive drum 1 stored in the memory 18, which serves as the storage unit, is deleted (reset).

If the control unit 10 determines in step S5 that the operation of removing the adhered matter that has adhered to the surface of the charging roller 2 does not need to be carried out on the basis of the use environment information of the image forming apparatus 11 detected by the environment sensor 16, the control unit 10 proceeds to step S9.

In step S9, the operation of removing the adhered matter that has adhered to the surface of the charging roller 2 is not carried out. Thereafter, the control unit 10 proceeds to step S10 and deletes (resets) the continuous travel distance a of the outer peripheral surface of the photosensitive drum 1 stored in the memory 18, which serves as the storage unit.

In addition, the control unit 10 carries out the following control in a case in which an irregular stop (emergency stop) of the image forming apparatus 11 is detected, such as a case in which the recording material 14 stored in a feed cassette (not illustrated) or the like runs out. The control unit 10 carries out the control of determining whether the cleaning voltage Vr composed of the pulsed AC voltage is to be applied to the charging roller 2 from the charging power source 12 as indicated in the adhered matter removing operation segment W in FIG. 2.

At this point, the control unit 10 carries out the control in the steps after step S5 of FIG. 3 and determines whether the adhered matter removing operation is necessary by referring to the memory 18 for the continuous travel distance a of the outer peripheral surface of the photosensitive drum 1 held at the time when the jamming of the recording material 14 has occurred.

It has been investigated whether the various parameters indicated in FIG. 4 have any influence when the operation of removing the adhered matter that has adhered to the surface of the charging roller 2 is carried out. The circumferential speed of the photosensitive drum 1 is set to 150 mm/sec. The charging voltage to be applied to the charging roller 2 from the charging power source 12 during image formation is set to −1100 V.

The cleaning voltage Vr to be applied to the charging roller 2 from the charging power source 12 during the operation of removing the adhered matter that has adhered to the surface of the charging roller 2 is set as follows. As indicated in the adhered matter removing operation segment W in FIG. 2, the cleaning voltage Vr is applied while repeatedly switching between ON (−1100 V in the exemplary embodiment) and OFF (0 V in the exemplary embodiment) at every 0.5 seconds.

Then, as illustrated in FIG. 4, the operation of removing the adhered matter that has adhered to the surface of the charging roller 2 is repeated so that the continuous travel distance a of the outer peripheral surface of the photosensitive drum 1 per instance of the adhered matter removing operation (per cycle Tr) reaches 730000 mm in total.

FIG. 4 illustrates the continuous travel distance a of the outer peripheral surface of the photosensitive drum 1 per instance of the adhered matter removing operation (per cycle Tr), and the number of times ON/OFF of the cleaning voltage Vr to be applied to the charging roller 2 from the charging power source 12 is repeated during the operation of removing the adhered matter that has adhered to the surface of the charging roller 2. In addition, FIG. 4 illustrates the use environment information of the image forming apparatus 11 that includes the temperature and the humidity. Furthermore, a vertical streak that is generated in a toner image transferred to the recording material 14 due to a charging failure of the surface of the photosensitive drum 1 by the charging roller 2 is evaluated. In the table, a circle indicates that no vertical streak is observed, a cross indicates that a noticeable vertical streak is observed, and a triangle indicates that an unnoticeable vertical streak is observed.

As illustrated in FIG. 4, the evaluation of the vertical streak caused by the charging failure of the surface of the photosensitive drum 1 by the charging roller 2 is as follows under the environmental condition in which the temperature is 15° C. and the humidity is 10%. The number of times ON/OFF of the cleaning voltage Vr to be applied to the charging roller 2 from the charging power source 12 is repeated during the operation of removing the adhered matter that has adhered to the surface of the charging roller 2 is set to five. Then, the continuous travel distance a of the outer peripheral surface of the photosensitive drum 1 increases (7300 mm as indicated in FIG. 4). In this case, the adhered matter accumulates on the surface of the charging roller 2, and a vertical streak is generated in the toner image transferred to the recording material 14 (the cross in FIG. 4).

In the meantime, while the continuous travel distance a of the outer peripheral surface of the photosensitive drum 1 is 7300 mm, the number of times ON/OFF of the cleaning voltage Vr to be applied to the charging roller 2 from the charging power source 12 is repeated during the operation of removing the adhered matter that has adhered to the surface of the charging roller 2 is increased to 20. In this case, as the number of times the adhered matter that has adhered to the surface of the charging roller 2 is removed is increased, a vertical streak is not generated in the toner image transferred to the recording material 14 (the circle in FIG. 4).

Meanwhile, as illustrated in FIG. 4, the following is observed under the environmental condition in which the temperature is 30° C. and the humidity is 80%. No adhered matter accumulates on the surface of the charging roller 2. Therefore, a vertical streak is not generated in the toner image transferred to the recording material 14 (the circle in FIG. 4) even though the operation of removing the adhered matter that had adhered to the surface of the charging roller 2 is not carried out (0 times as indicated in FIG. 4).

On the basis of the result indicated in FIG. 4, the control unit 10 operates as follows in the operation of removing the adhered matter that has adhered to the surface of the charging roller 2. For example, when the use environment information of the image forming apparatus 11 indicates the high-temperature high-humidity environmental condition in which the temperature is 27° C. or higher and the humidity is 70% or higher, the control unit 10 carries out the control in accordance with the use environment condition of the image forming apparatus 11 so that the operation of removing the adhered matter that has adhered to the surface of the charging roller 2 is not carried out.

In the exemplary embodiment, with regard to the operation of removing the adhered matter that has adhered to the surface of the charging roller 2, the adhered matter removing operation (1) in step S7 of FIG. 3 is as follows. The number n of times ON/OFF of the cleaning voltage Vr to be applied to the charging roller 2 from the charging power source 12 is repeated during the operation of removing the adhered matter that has adhered to the surface of the charging roller 2 is set to 20.

Meanwhile, in the adhered matter removing operation (2) in step S8 of FIG. 3, the number q (<n) of times ON/OFF of the cleaning voltage Vr to be applied to the charging roller 2 from the charging power source 12 is repeated during the operation of removing the adhered matter that has adhered to the surface of the charging roller 2 is set to five.

The threshold value A for the continuous travel distance a of the outer peripheral surface of the photosensitive drum 1 in step S6 of FIG. 3 is set to 7000 mm.

In the exemplary embodiment, the operation of removing the adhered matter that has adhered to the surface of the charging roller 2 is controlled in accordance with the continuous travel distance a of the outer peripheral surface of the photosensitive drum 1 or the use environment information of the image forming apparatus 11.

Then, the control is carried out such that the number of times ON/OFF of the cleaning voltage Vr in the removing operation is repeated (the duration for which the cleaning voltage Vr is applied) increases as the continuous travel distance a of the outer peripheral surface of the photosensitive drum 1 increases.

Thus, the adhered matter that has adhered to the surface of the charging roller 2 is removed effectively, and unnecessary use of the photosensitive drum 1 can be suppressed.

In the exemplary embodiment, an example in which the operation of removing the adhered matter that has adhered to the surface of the charging roller 2 is controlled in accordance with the various parameters indicated in FIG. 4 has been described. Alternatively, various other parameters can also be set as appropriate.

According to the exemplary embodiment, the operation information of the image forming apparatus 11 is detected by the control unit 10, which also functions as the operation detection unit. Thus, a situation in which the adhered matter that has adhered to the charging roller 2 is likely to accumulate can be grasped. Then, the operation of removing the adhered matter that has adhered to the surface of the charging roller 2 can be carried out on the basis of the operation information of the image forming apparatus 11.

Thus, the image forming apparatus 11 that can remove the adhered matter on the charging roller 2 even when images are formed successively can be provided.

In the exemplary embodiment, "the number of times ON/OFF of the cleaning voltage Vr is repeated as the removing operation" is controlled in accordance with the continuous travel distance a of the outer peripheral surface of the photosensitive drum 1, but the target of the control is not limited thereto.

For example, the control may be carried out so that "the duration for which ON/OFF of the cleaning voltage Vr is repeated as the removing operation" extends as the continuous travel distance a of the outer peripheral surface of the photosensitive drum 1 increases.

Second Exemplary Embodiment

Next, a configuration of an image forming apparatus according to a second exemplary embodiment of the invention will be described with reference to FIG. 5. It is to be noted that the configurations similar to those of the first exemplary embodiment are given identical reference characters or identical names with different reference characters, and descriptions thereof will be omitted.

When the operation of removing the adhered matter that has adhered to the surface of the charging roller 2 is carried out, it is also possible to control the surface potential of the photosensitive drum 1 that has not been charged by the charging roller 2. By changing the surface potential of the photosensitive drum 1, the operation of removing the adhered matter that has adhered to the surface of the charging roller 2 can be carried out in accordance with the chargeability of the adhered matter that has adhered to the surface of the charging roller 2.

With regard to the control of the surface potential of the photosensitive drum 1 that has not been charged by the charging roller 2, for example, it is possible to control the surface potential of the photosensitive drum 1 by controlling the transfer voltage applied to the transfer roller 5, which serves as the transfer unit, from the transfer power source 13 illustrated in FIG. 1.

Figure 5:
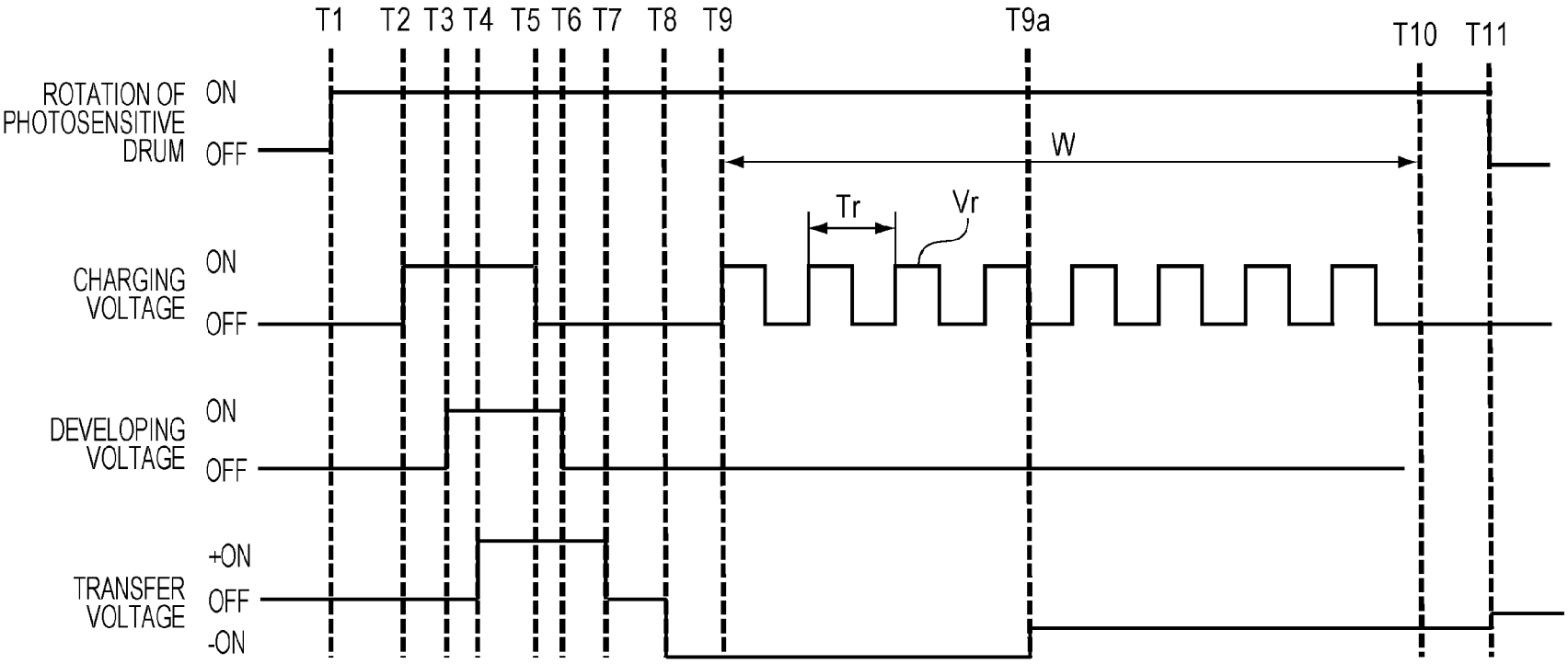
FIG. 5 is a timing chart illustrating an image formation operation of an image forming apparatus according to a second exemplary embodiment of the invention.

The following is carried out while the cleaning voltage Vr composed of the AC voltage is applied to the charging roller 2 from the charging power source 12 during the non-image-forming operation of the image forming apparatus 11, as indicated in the adhered matter removing operation segment W in FIG. 5. The transfer voltage to be applied to the transfer roller 5, which serves as a unit other than the charging unit, is changed. Thus, the surface potential of the photosensitive drum 1 can be changed.

In the exemplary embodiment, the control unit 10 controls the surface potential of the photosensitive drum 1 in the middle of the operation of removing the adhered matter that has adhered to the surface of the charging roller 2. For example, the transfer voltage applied to the transfer roller 5, which serves as the transfer unit, from the transfer power source 13 is changed.

Next, an example in which the transfer voltage applied to the transfer roller 5 is switched in the middle of the operation of removing the adhered matter that has adhered to the surface of the charging roller 2 will be described with reference to FIG. 5. FIG. 5 illustrates an example in which the transfer voltage applied to the transfer roller 5 is changed in the middle of the operation of removing the adhered matter that has adhered to the surface of the charging roller 2, as compared to the timing chart of the image forming operation illustrated in FIG. 2.

FIG. 5 illustrates the following, as compared to the timing chart of the image forming operation illustrated in FIG. 2 described above. During a period from a time T9*a* (T9<T9*a*<T10), which is within the adhered matter removing operation segment W spanning from the time T9 to the time T10, to the time T11 (>T10), which is after the adhered matter removing operation segment W has passed, the transfer voltage of −1100 V is applied to the transfer roller 5, which serves as the transfer unit, from the transfer power source 13.

In FIG. 2, the control unit 10 controls the surface potential of the photosensitive drum 1 to stay constant during the operation of removing the adhered matter that has adhered to the surface of the charging roller 2. FIG. 5 illustrates an example in which the control unit 10 controls the transfer voltage applied to the transfer roller 5 from the transfer power source 13 to change during the operation of removing the adhered matter that has adhered to the surface of the charging roller 2.

The control unit 10 carries out the following control during a period from the time T9 to the time T9*a* (T9<T9*a*<T10) illustrated in FIG. 5. The control unit 10 carries out the following control during a period from the time T8 to the time T9*a* (T9<T9*a*<T10) illustrated in FIG. 5 so that the surface potential of the photosensitive drum 1 becomes −750 V. The transfer voltage of −1300 V is applied to the transfer roller 5 from the transfer power source 13.

In addition, the control unit 10 carries out the following control during a period from the time T9*a* to the time T10 (>T9*a*) illustrated in FIG. 5. The control unit 10 carries out the following control during a period from the time T9*a* to the time T11 (>T10) illustrated in FIG. 5 so that the surface potential of the photosensitive drum 1 becomes −550 V. The transfer voltage of −1100 V is applied to the transfer roller 5, which serves as the transfer unit, from the transfer power source 13.

As illustrated in FIG. 5, during the period in which the cleaning voltage Vr to be applied to the charging roller 2 from the charging power source 12 is ON, the charging voltage of −1100 V is applied to the charging roller 2 from the charging power source 12.

In addition, during the period in which the cleaning voltage Vr to be applied to the charging roller 2 from the charging power source 12 is OFF, the charging voltage is not applied to the charging roller 2 from the charging power source 12 (0 V).

During the period from the time T9 to the time T9*a* illustrated in FIG. 5, the following setting is employed so that the adhered matter of positive polarity that has adhered to the surface of the charging roller 2 is removed more easily during the period in which the cleaning voltage Vr to be applied to the charging roller 2 from the charging power source 12 is OFF.

The transfer voltage (−1300 V) with a large absolute value is applied to the transfer roller 5 so that the potential difference between the surface potential of the photosensitive drum 1 and the surface potential of the charging roller 2 becomes large.

Thereafter, during the period from the time T9*a* to the time T10 illustrated in FIG. 5, a focus is placed on the adhered matter of negative polarity that has adhered to the surface of the charging roller 2 during the period in which the charging voltage applied to the charging roller 2 from the charging power source 12 is ON.

Then, the following is observed as compared to the potential difference between the surface potential of the photosensitive drum 1 and the surface potential of the charging roller 2 during the period from the time T9 to the time T9*a* illustrated in FIG. 5. The surface potential of the photosensitive drum 1 during the period from the time T9*a* to the time T10 illustrated in FIG. 5 is considered. Then, the following is carried out so that the potential difference between the surface potential of the photosensitive drum 1 and the surface potential of the charging roller 2 increases. The transfer voltage applied to the transfer roller 5 from the transfer power source 13 during the period from the time T9*a* to the time T11 (>T10) illustrated in FIG. 5 is lowered to −1100 V in terms of the absolute value.

As described thus far, the transfer voltage applied to the transfer roller 5 is changed during the operation of removing the adhered matter that has adhered to the surface of the charging roller 2. Thus, the adhered matter can be removed effectively in accordance with the charge polarity of the adhered matter that has adhered to the surface of the charging roller 2.

Alternatively, it is also possible to control the surface potential of the photosensitive drum 1 by changing the exposure amount by which the surface of the photosensitive drum 1 is exposed by the laser scanner 3, which serves as the image exposure unit, or by an exposure unit (not illustrated). Other configurations are similar to those of the first exemplary embodiment, and effects similar to those of the first exemplary embodiment can be obtained.

Third Exemplary Embodiment

Next, a configuration of an image forming apparatus according to a third exemplary embodiment of the invention will be described with reference to FIGS. 6 through 8. It is to be noted that the configurations similar to those of the foregoing exemplary embodiments are given identical reference characters or identical names with different reference characters, and descriptions thereof will be omitted.

Figure 6:
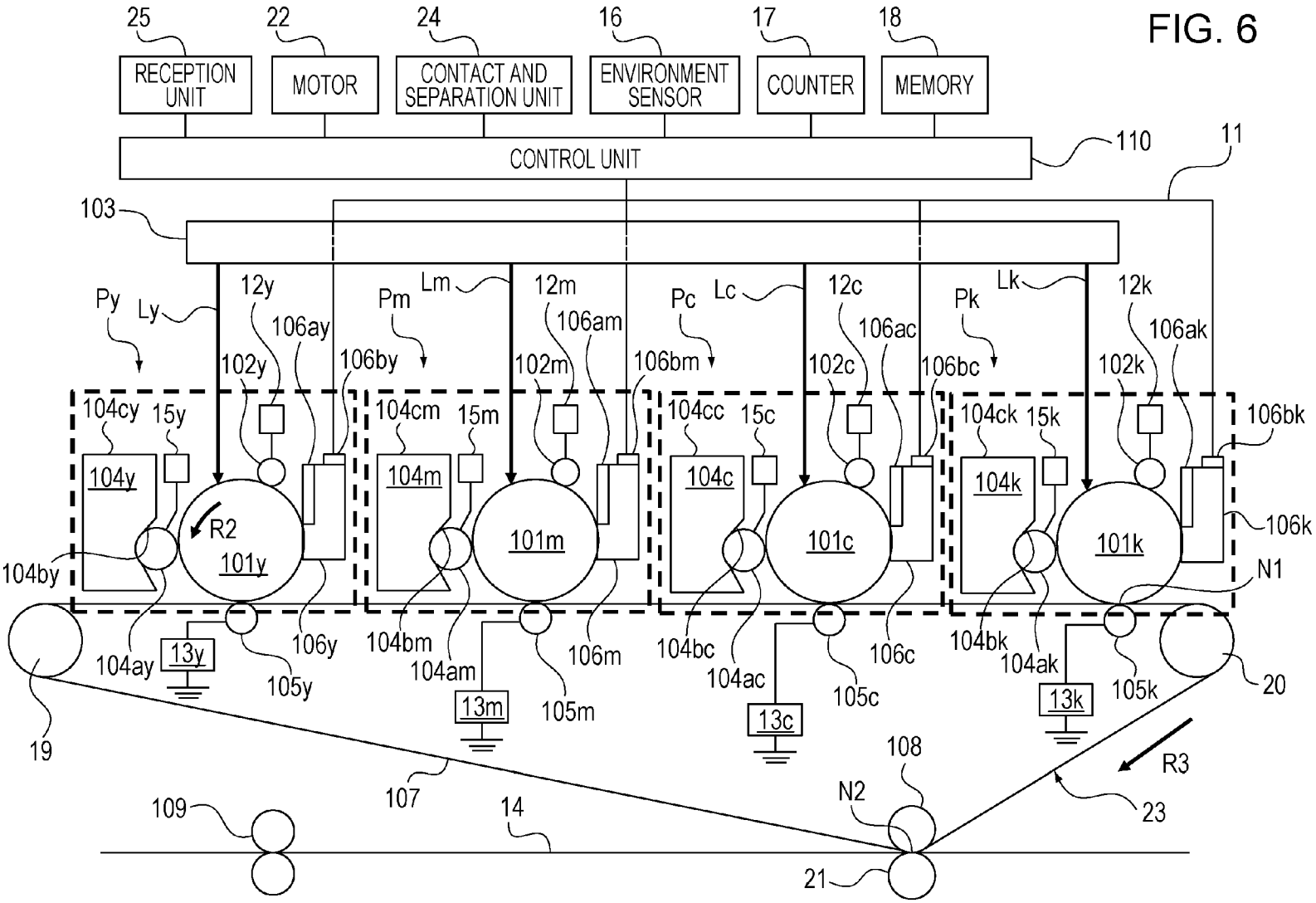
FIG. 6 is a sectional diagram illustrating a configuration of an image forming apparatus according to a third exemplary embodiment of the invention.

FIG. 6 is a sectional diagram illustrating a configuration of the image forming apparatus according to the third exemplary embodiment of the invention. In the exemplary embodiment, as illustrated in FIG. 6, configurations surrounding photosensitive drums 101*y*, 101*m*, 101*c*, and 101*k*, which serve as image bearing members, for the respective colors of yellow y, magenta m, cyan c, and black k are as follows.

Developing rollers 104*ay*, 104*am*, 104*ac*, and 104*ak*, which serve as developer bearing members, provided for respective developing devices 104*y*, 104*m*, 104*c*, and 104*k*, which serve as developing units, are configured to be capable of making contact with and being separated from the photosensitive drums 101*y*, 101*m*, 101*c*, and 101*k*, respectively, by a contact and separation unit 24, which serves as a contact and separation unit.

For simplifying the description, the photosensitive drums 101*y*, 101*m*, 101*c*, and 101*k* may collectively be referred to as simply the photosensitive drum 101. The same applies to the other image forming process units.

In the exemplary embodiment, in addition to the continuous travel distance a1 of the outer peripheral surface of the photosensitive drum 101 described in the foregoing exemplary embodiments, the following is considered. Weighting is carried out with the continuous travel distance a2 of the outer peripheral surface of the photosensitive drum 101 while the developing roller 104*a* of the developing device 104, which serves as the developing unit, is in contact with the surface of the photosensitive drum 101 taken into consideration.

A control unit 110, which also functions as the operation detection unit, detects the operation information of the developing roller 104*a* of the developing device 104, which serves as the developing unit, as the operation information of the image forming apparatus 11. Thus, the operation of removing the adhered matter that has adhered to the surface of a charging roller 102 can be carried out effectively.

The configuration of the image forming apparatus 11 and the image forming operation according to the exemplary embodiment will be described with reference to FIG. 6.

Image Forming Apparatus

As illustrated in FIG. 6, the image forming apparatus 11 according to the exemplary embodiment includes the main body of the image forming apparatus 11 and a plurality of process cartridges Py, Pm, Pc, and Pk that are detachably mounted to the main body of the image forming apparatus 11.

The process cartridge Py forms a toner image of yellow y, the process cartridge Pm forms a toner image of magenta m, the process cartridge Pc forms a toner image of cyan c, and the process cartridge Pk forms a toner image of black k.

Stations to which the process cartridges Py, Pm, Pc, and Pk are mounted are referred to as a first station, a second station, a third station, and a fourth station, respectively.

Image Forming Operation

The image forming operation will be described with the use of the process cartridge Py in the first station. The photosensitive drum 101*y*, which serves as the image bearing member, is rotationally driven in the direction indicated by the arrow R2 in FIG. 6 by the motor 22, which serves as the driving source.

The photosensitive drum 101*y* is charged uniformly to a predetermined potential by the charging roller 102*y*, which serves as the charging unit, that makes contact with the surface of the photosensitive drum 101*y* and is rotated so as to follow the surface of the photosensitive drum 101*y*.

The surface of the photosensitive drum 101*y* is exposed by a laser beam Ly emitted by a laser scanner 103, which serves as the image exposure unit, in accordance with the image information. Thus, a desired electrostatic latent image corresponding to the image information is formed.

A developer container 104*cy* of the developing device 104*y*, which serves as the developing unit, stores non-magnetic mono-component toner of negative chargeability. The developing roller 104*ay*, which serves as the developer bearing member, is rotatably provided on the frame of the developing device 104*y*.

A developing blade 104*by* makes contact with the surface of the developing roller 104*ay*. The developing blade 104*by* provides a charge to the developer (toner) held on the surface of the developing roller 104*ay*.

The non-magnetic mono-component toner of negative chargeability stored in the developer container 104*cy* of the developing device 104*y* is composed of a host member made of resin particles or the like and an external additive made of silica or inorganic fine particles of positive chargeability.

The image forming apparatus 11 includes the contact and separation unit 24, which serves as the contact and separation unit, illustrated in FIG. 6, and the contact and separation unit 24 causes the surface of the developing roller 104*a* and the surface of the photosensitive drum 101 to make contact with each other or to be separated from each other.

The developing roller 104*ay* makes contact with the surface of the photosensitive drum 101*y* at a predetermined timing, and supplies the toner of yellow y held on the surface of the developing roller 104*ay* to the surface of the photosensitive drum 101*y*.

Thus, the toner of yellow y is supplied to the electrostatic latent image formed on the surface of the photosensitive drum 101*y* by the laser scanner 103, and the electrostatic latent image is developed into a toner image of yellow y.

Meanwhile, configurations opposing the photosensitive drums 101*y*, 101*m*, 101*c*, and 101*k* for the respective colors of yellow y, magenta m, cyan c, and black k are as follows. An intermediate transfer belt 107, which serves as a transfer body, is provided so as to be rotatable in the direction indicated by the arrow R3 in FIG. 6, and the intermediate transfer belt 107 is stretched around tension rollers 19 and 20 and a secondary transfer inner roller 108.

The toner image of yellow y formed on the surface of the photosensitive drum 101*y* undergoes a primary transfer onto the outer surface of the intermediate transfer belt 107 at a primary transfer nip portion N1 by a primary transfer roller 105*y*, which serves as a primary transfer unit, provided on the inner surface side of the intermediate transfer belt 107.

The toner image of yellow y that has undergone the primary transfer onto the outer surface of the intermediate transfer belt 107 is conveyed to the right in FIG. 6 as the intermediate transfer belt 107 rotates in the direction indicated by the arrow R3 in FIG. 6.

The residual toner that remains on the surface of the photosensitive drum 101*y* without undergoing the primary transfer onto the outer surface of the intermediate transfer belt 107 is scraped and removed by a cleaning blade 106*ay* that is in contact with the surface of the photosensitive drum 101*y*.

The cleaning blade 106*ay* is fixed to a cleaning device 106*y*, which serves as a cleaning unit, that collects the residual toner. A urethane rubber portion is provided at the leading edge of the cleaning blade 106*ay*, and the urethane rubber portion is brought into contact with the photosensitive drum 101*y* in the direction counter to the direction in which the photosensitive drum 101*y* rotates.

In each of the process cartridges Pm, Pc, and Pk for the respective colors of magenta m, cyan c, and black k as well, the image forming operation similar to that in the process cartridge Py for yellow y is carried out. Thus, toner images of magenta m, cyan c, and black k undergo the primary transfer so as to be superimposed onto the toner image of yellow y that has undergone the primary transfer onto the outer surface of the intermediate transfer belt 107.

A secondary transfer outer roller 21, which serves as a secondary transfer unit, is provided so as to oppose the secondary transfer inner roller 108 with the intermediate transfer belt 107 interposed therebetween. The toner images superimposed on the outer surface of the intermediate transfer belt 107 undergo the following. The superimposed toner images reach a secondary transfer nip portion N2 formed by the outer surface of the intermediate transfer belt 107 and the secondary transfer outer roller 21. In synchronization with that timing, the recording material 14 is conveyed to the secondary transfer nip portion N2 by a conveyance unit (not illustrated).

Then, the toner images superimposed on the outer surface of the intermediate transfer belt 107 undergo a secondary transfer onto the recording material 14 at once by the secondary transfer outer roller 21, which serves as the secondary transfer unit.

Thereafter, the recording material 14 on which the unfixed toner images are formed is pinched and conveyed by a fixing roller and a pressure roller provided in a fixing device 109, which serves as a fixing unit, and the unfixed toner images are heated and pressurized during that time. Thus, the unfixed toner images are thermally melted and then thermally fixed onto the recording material 14.

The cleaning device 106 of each process cartridge P is provided with a storage device 106*b*, which serves as a storage unit, that stores use history information of the process cartridge P.

The control unit 110, which serves as the controller, that controls the image forming apparatus 11 writes information into the storage device 106*b* of the process cartridge P mounted to the main body of the image forming apparatus 11. Alternatively, the control unit 110 retrieves information stored in the storage device 106*b* to refer to the use history information of the process cartridge P.

The main body of the image forming apparatus 11 is provided with the environment sensor 16, which serves as the environment detection unit. The use environment information of the image forming apparatus 11 is detected by the environment sensor 16. The use environment information detected by the environment sensor 16 is transmitted to the control unit 110, which also functions as the operation detection unit. Thus, the control unit 110 can grasp the use environment information (the temperature and the humidity) of the image forming apparatus 11.

The motor 22, which serves as the driving source, that rotationally drives each photosensitive drum 101 in the main body of the image forming apparatus 11 alone rotationally drives the process cartridges Py, Pm, Pc, and Pk simultaneously.

The main body of the image forming apparatus 11 is provided with an intermediate transfer unit 23 in which the intermediate transfer belt 107 and the primary transfer roller 105 are integrated into a unit. Furthermore, a contact and separation unit, which serves as a contact and separation unit, (not illustrated) that causes the outer surface of the intermediate transfer belt 107 of the intermediate transfer unit 23 and the surface of the photosensitive drum 101 to make contact with each other or to be separated from each other is provided.

There is a full color mode in which the process cartridges Py, Pm, Pc, and Pk for the respective colors of yellow y, magenta m, cyan c, and black k are put into operation. In addition, there is a mono color mode in which only one of the process cartridges P for one color is put into operation. As the control unit 110 operates the contact and separation unit (not illustrated), a photosensitive drum 101 to be brought into contact with the outer surface of the intermediate transfer belt 107 is selected.

Typically, while the image forming apparatus 11 is standing by for a print command, the surfaces of the photosensitive drums 101*y*, 101*m*, 101*c*, and 101*k* of the process cartridges Py, Pm, Pc, and Pk are put in contact with the outer surface of the intermediate transfer belt 107.

When an image is to be formed in the full color mode, the surfaces of the photosensitive drums 101*y*, 101*m*, 101*c*, and 101*k* of the process cartridges Py, Pm, Pc, and Pk are put in contact with the outer surface of the intermediate transfer belt 107, and the image is formed in that state.

Meanwhile, when an image is to be formed in a mono color mode of black k, for example, the surfaces of the photosensitive drums 101*y*, 101*m*, and 101*c* of the process cartridges Py, Pm, and Pc for yellow y, magenta m, and cyan c are separated from the outer surface of the intermediate transfer belt 107.

Then, the surface of only the photosensitive drum 101*k* of the process cartridge Pk for black k is put in contact with the outer surface of the intermediate transfer belt 107, and the image is formed in that state.

For example, the operation of the process cartridges Py, Pm, and Pc in the mono color mode of black k involves only the rotational driving of the photosensitive drums 101*y*, 101*m*, and 101*c* by the motor 22 upon a print command having been received.

In addition, the charging voltages to be applied to the charging rollers 102*y*, 102*m*, 102*c*, and 102*k* of the process cartridges Py, Pm, Pc, and Pk are controlled for each process cartridge P.

For example, in the mono color mode of black k, the charging voltage is not applied to the charging rollers 102*y*, 102*m*, and 102*c* of the process cartridges Py, Pm, and Pc for yellow y, magenta m, and cyan c, respectively.

The control unit 110 switches between the full color mode and the mono color mode of the image forming apparatus 11 in accordance with a print command input to the reception unit 25 of the image forming apparatus 11.

In addition, with regard to the operation during a period corresponding to an interval between images formed in continuous printing, a solid white image is formed in a similar manner to that of forming an image.

In the exemplary embodiment, in addition to the continuous travel distance a1 of the outer peripheral surface of the photosensitive drum 101, the duration for which the developing roller 104*a* is in contact with the surface of the photosensitive drum 101 is taken into consideration. The operation of removing the adhered matter that has adhered to the surface of the charging roller 102 in the aforementioned case will be described.

While the developing roller 104*a* is in contact with the surface of the photosensitive drum 101, fogging toner or an external additive of polarity that is opposite to the polarity of the toner on the surface of the developing roller 104*a* may be supplied to the surface of the photosensitive drum 101. Thus, the amount of adhered matter that moves to the charging roller 102 from the surface of the photosensitive drum 101 may increase.

Next, the operation of removing the adhered matter that has adhered to the surface of the charging roller 102 will be described with reference to FIG. 7. FIG. 7 is a flowchart illustrating the operation of removing the adhered matter that has adhered to the surface of the charging roller 102 according to the exemplary embodiment.

Figure 7:
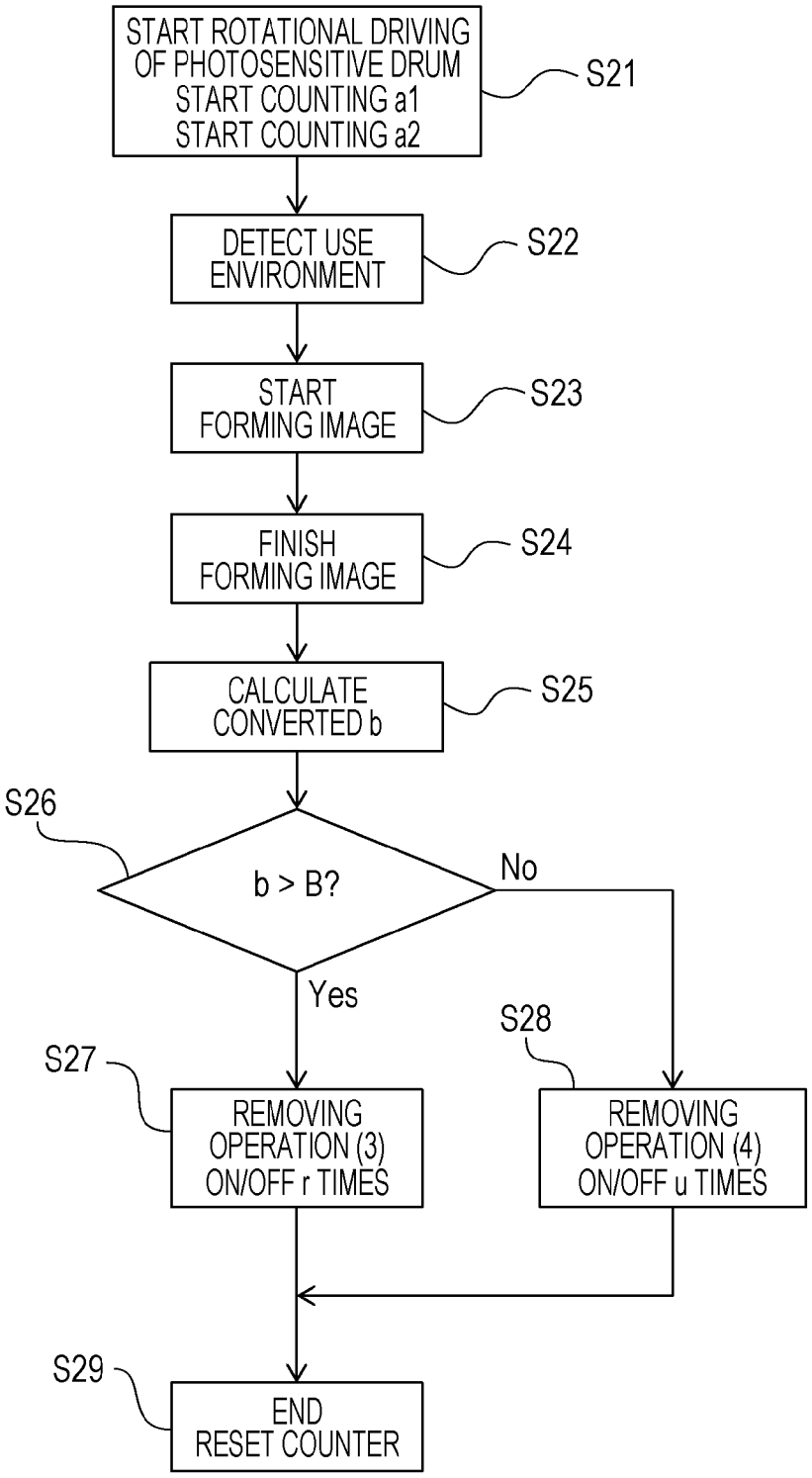
FIG. 7 is a flowchart illustrating a control operation of removing adhered matter that has adhered to a charging unit according to the third exemplary embodiment.

In step S21 of FIG. 7, the control unit 110 starts rotationally driving the photosensitive drum 101, upon the reception unit 25 of the image forming apparatus 11 receiving a print command. At the same time, the counter 17 starts counting the continuous travel distance a1 of the outer peripheral surface of the photosensitive drum 101.

Furthermore, the control unit 110, which also functions as the operation detection unit, starts counting, with the counter 17, the continuous travel distance a2 of the outer peripheral surface of the photosensitive drum 101 for the duration for which the developing roller 104*a* is in contact with the surface of the photosensitive drum 101 on the basis of the operation information of the developing roller 104*a*.

In step S22, the control unit 110 acquires the use environment information of the image forming apparatus 11 that includes the temperature and the humidity detected by the environment sensor 16.

Then, the control unit 110 carries out the image forming operation of the image forming apparatus 11 in step S23 and finishes the image forming operation in step S24.

In step S25, the control unit 110 considers the continuous travel distance a1 of the outer peripheral surface of the photosensitive drum 101. Furthermore, the control unit 110 considers the continuous travel distance a2 of the outer peripheral surface of the photosensitive drum 101 for the duration for which the developing roller 104*a* is in contact with the surface of the photosensitive drum 101. Then, the control unit 110 converts the continuous travel distances a1 and a2 into the continuous travel distance b of the outer peripheral surface of the photosensitive drum 101 through the following expression (1) with the use of weighting coefficients α (e.g., 1) and β (e.g., 2) set in advance.

$$b=(a1-a2)\times\alpha+a2\times\beta$$

In step S26, the control unit 110 determines whether the continuous travel distance b of the outer peripheral surface of the photosensitive drum 1 that has been converted through the expression (1) above exceeds a threshold value B (12000 mm in the exemplary embodiment) set in advance.

The converted continuous travel distance b of the outer peripheral surface of the photosensitive drum 101 is as follows. The continuous travel distance a1 of the outer peripheral surface of the photosensitive drum 101 counted by the counter 17 at the time at which the image forming operation has finished in step S24 is considered. Furthermore, the continuous travel distance a2 of the outer peripheral surface of the photosensitive drum 101 for the duration for which the developing roller 104*a* is in contact with the surface of the photosensitive drum 101 is considered.

If it is determined in step S26 that the converted continuous travel distance b of the outer peripheral surface of the photosensitive drum 101 exceeds the threshold value B, the control unit 110 proceeds to step S27. In step S27, an adhered matter removing operation (3) is carried out. As indicated in the adhered matter removing operation segment W in FIG. 2, the following is carried out after the image forming operation of the image forming apparatus 11 is finished on the basis of the operation information of the developing roller 104*a* detected by the control unit 110, which also functions as the operation detection unit.

The cleaning voltage Vr composed of the pulsed AC voltage having the predetermined cycle Tr is applied to the charging roller 102 from the charging power source 12 while repeating ON/OFF of the cleaning voltage Vr r times (20 times in the exemplary embodiment) with the cycle Tr during the non-image-forming operation of the image forming apparatus 11.

Thereafter, the control unit 110 proceeds to step S29 to finish the adhered matter removing operation (3) and resets the count values of the continuous travel distances a1 and a2 of the outer peripheral surface of the photosensitive drum 101 stored in the memory 18.

If it is determined in step S26 that the converted continuous travel distance b of the outer peripheral surface of the photosensitive drum 101 is no greater than the threshold value B, the control unit 110 proceeds to step S28. In step S28, an adhered matter removing operation (4) is carried out. As indicated in the adhered matter removing operation segment W in FIG. 2, the following is carried out after the image forming operation of the image forming apparatus 11 is finished on the basis of the operation information of the developing roller 104*a* detected by the control unit 110, which also functions as the operation detection unit.

The cleaning voltage Vr composed of the pulsed AC voltage having the predetermined cycle Tr is applied to the charging roller 102 from the charging power source 12 while repeating ON/OFF of the cleaning voltage Vr u times (five times in the exemplary embodiment) with the cycle Tr during the non-image-forming operation of the image forming apparatus 11.

Thereafter, the control unit 110 proceeds to step S29 to finish the adhered matter removing operation (4) and resets the count values of the continuous travel distances a1 and a2 of the outer peripheral surface of the photosensitive drum 101 stored in the memory 18.

In addition, the control unit 110, which also functions as the operation detection unit, operates as follows. The control unit 110 may detect an irregular stop (emergency stop) of the image forming apparatus 11, such as a case in which the recording material 14 stored in a feed cassette (not illustrated) or the like runs out. In such a case as well, the control unit 110 carries out the control of determining whether the cleaning voltage Vr composed of the pulsed AC voltage is to be applied to the charging roller 102 from the charging power source 12.

In other words, the control unit 110 carries out the control in steps after step S25 illustrated in FIG. 7. The continuous travel distance a1 of the outer peripheral surface of the photosensitive drum 101 at the time when the jamming of the recording material 14 has occurred is considered. Furthermore, the continuous travel distance a2 of the outer peripheral surface of the photosensitive drum 101 for the duration for which the developing roller 104*a* is in contact with the surface of the photosensitive drum 101 is considered. By referring to these pieces of information in the memory 18, the control unit 110 determines whether the adhered matter removing operation is necessary.

FIG. 8 illustrates the result obtained by investigating the influence of the parameters when the adhered matter removing operation according to the exemplary embodiment is carried out. The circumferential speed of the photosensitive drum 101 is set to 150 mm/sec. The charging voltage to be applied to the charging roller 102 from the charging power source 12 during the normal image forming operation is set to −1100 V.

The cleaning voltage Vr composed of the pulsed AC voltage to be applied to the charging roller 102 from the charging power source 12 during the operation of removing the adhered matter that has adhered to the surface of the charging roller 102 is set to −1100 V when the cleaning voltage Vr is ON and set to 0 V when the cleaning voltage Vr is OFF.

The cleaning voltage Vr composed of the pulsed AC voltage to be applied to the charging roller 102 from the charging power source 12 during the operation of removing the adhered matter that has adhered to the surface of the charging roller 102 is turned ON/OFF repeatedly at every 0.5 seconds.

With regard to the use environment of the image forming apparatus 11, the temperature is 15° C., and the humidity is 10%. The process cartridge Pm is used for the evaluation of a vertical streak associated with a charging failure of the surface of the photosensitive drum 101 by the charging roller 102 illustrated in FIG. 8.

The continuous travel distance a1 of the outer peripheral surface of the photosensitive drum 101 is considered. Furthermore, the continuous travel distance a2 of the outer peripheral surface of the photosensitive drum 101 for the duration for which the developing roller 104*a* is in contact with the surface of the photosensitive drum 101 is considered. Then, the continuous travel distance b of the outer peripheral surface of the photosensitive drum 101 that has been converted through the expression (1) above is set to become 730000 mm in total.

FIG. 8 illustrates the print mode of the image forming apparatus 11 and the continuous travel distance a1 of the outer peripheral surface of the photosensitive drum 101 per instance of the adhered matter removing operation (per cycle Tr). Furthermore, FIG. 8 illustrates the continuous travel distance a2 of the outer peripheral surface of the photosensitive drum 101 per instance of the adhered matter removing operation (per cycle Tr) in a state in which the developing roller 104*a* is in contact with the surface of the photosensitive drum 101. Furthermore, FIG. 8 illustrates the continuous travel distance b of the outer peripheral surface of the photosensitive drum 101 that has been converted through the expression (1) above.

Furthermore, FIG. 8 illustrates the number of times ON/OFF of the cleaning voltage Vr composed of the pulsed AC voltage to be applied to the charging roller 102 from the charging power source 12 is repeated in the adhered matter removing operation segment W indicated in FIG. 2. Furthermore, FIG. 8 illustrates the relationship with respect to a vertical streak generated in a toner image formed on the surface of the recording material 14 due to the charging failure of the surface of the photosensitive drum 101 by the charging roller 102.

In FIG. 8, a focus is placed on the mono color mode and the full color mode in a case in which the continuous travel distance a1 of the outer peripheral surface of the photosensitive drum 101 per instance of the adhered matter removing operation (per cycle Tr) is 7300 mm. In the case of the mono color mode, the photosensitive drum 101 rotates in a state in which the developing rollers 104*a* of the other colors are separated from the surface of the photosensitive drum 101.

Therefore, a case in which the photosensitive drum 101 rotates in a state in which the developing rollers 104*a* of all the colors are in contact with the surface of the photosensitive drum 101 in the full color mode is considered. As compared to this case, FIG. 8 reveals that the vertical streak is not generated in a toner image formed on the surface of the recording material 14 even when the continuous travel distance a1 of the outer peripheral surface of the photosensitive drum 101 is the same.

Furthermore, the continuous travel distance a1 of the outer peripheral surface of the photosensitive drum 101 is increased to 14600 mm in the mono color mode. In this case, a vertical streak is generated in a toner image formed on the surface of the recording material 14 when the number of times ON/OFF of the cleaning voltage Vr composed of the pulsed AC voltage to be applied to the charging roller 102 from the charging power source 12 is repeated in the adhered matter removing operation segment W indicated in FIG. 2 is five.

Meanwhile, the continuous travel distance a1 of the outer peripheral surface of the photosensitive drum 101 is increased to 14600 mm in the mono color mode. Furthermore, the number of times ON/OFF of the cleaning voltage Vr composed of the pulsed AC voltage to be applied to the charging roller 102 from the charging power source 12 is repeated in the adhered matter removing operation segment W indicated in FIG. 2 is increased to 20. In this case, the vertical streak is not generated in a toner image formed on the surface of the recording material 14.

In addition, in FIG. 8, the continuous travel distance b of the outer peripheral surface of the photosensitive drum 101 that has been converted through the expression (1) above is as follows. The weighting coefficient $\alpha$ when the photosensitive drum 101 rotates in the expression (1) above is set to 1. Furthermore, a value obtained when the weighting coefficient $\beta$ while the developing roller 104*a* is in contact with the surface of the photosensitive drum 101 is set to 2 is illustrated.

In the exemplary embodiment, the threshold value B for the continuous travel distance b of the outer peripheral surface of the photosensitive drum 101 that has been converted through the expression (1) above is set to 12000 mm. Then, the number r of times ON/OFF of the cleaning voltage Vr composed of the pulsed AC voltage to be applied to the charging roller 102 from the charging power source 12 is repeated in the adhered matter removing operation segment W indicated in FIG. 2 in the adhered matter removing operation (3) in step S27 of FIG. 7 is set to 20.

In addition, the number u of times ON/OFF of the cleaning voltage Vr composed of the pulsed AC voltage to be applied to the charging roller 102 from the charging power source 12 is repeated in the adhered matter removing operation segment W indicated in FIG. 2 in the adhered matter removing operation (4) in step S28 of FIG. 7 is set to five.

In the present exemplary embodiment, in addition to the continuous travel distance a1 of the outer peripheral surface of the photosensitive drum 101, the continuous travel distance a2 of the outer peripheral surface of the photosensitive drum 101 in a state in which the developing roller 104*a* is in contact with the surface of the photosensitive drum 101 is also considered.

Thus, the adhered matter that has adhered to the surface of the charging roller 102 is removed, and unnecessary use of the photosensitive drum 101 can be suppressed.

It is to be noted that various other parameters aside from the various parameters illustrated in FIG. 8 can also be set.

As in the exemplary embodiment, when the plurality of process cartridges P corresponding to the respective colors are provided in the image forming apparatus 11, the external additive for the toner may differ for the different colors. In that case, the amount of the adhered matter that adheres to the surface of the charging roller 102 may differ for the different external additives.

In that case, it is possible to vary the threshold value B for the continuous travel distance b of the outer peripheral surface of the photosensitive drum 101 (the moving distance of the image bearing member) that has been converted through the expression (1) above among the process cartridges P. Alternatively, it is possible to vary the method of counting the continuous travel distance of the outer peripheral surface of the photosensitive drum 101 (the moving distance of the image bearing member) among the process cartridges P.

Thus, the amount of the use of the photosensitive drum 101 can be kept to a minimum while suppressing the generation of a vertical streak in a toner image formed on the surface of the recording material 14. Other configurations are similar to those of the foregoing exemplary embodiments, and effects similar to those of the foregoing exemplary embodiments can be obtained.

While the invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-188059 filed Sep. 25, 2015, which is hereby incorporated by reference herein in its entirety.

What is claimed is:

1. An image forming apparatus configured to carry out an image forming operation of forming an image on a recording material, the image forming apparatus comprising:

an image bearing member configured to be rotatable;

a charging member configured to charge the image bearing member;

a voltage application device configured to apply a voltage to the charging member;

an image exposure device configured to form an electrostatic latent image on the image bearing member charged by the charging member;

a developing device configured to supply developer to the electrostatic latent image formed on the image bearing member by the image exposure device so as to develop the electrostatic latent image into a toner image;

a transfer member configured to transfer the toner image formed on the image bearing member by the developing device onto a transfer body;

a detection unit configured to detect operation information of the image forming apparatus; and a controller configured to cause the voltage application device to apply an AC voltage to the charging member during a non-image-forming operation of the image forming apparatus, an environment detection unit configured to detect use environment information of the image forming apparatus, wherein the controller is configured to control a duration for which the AC voltage is applied on the basis of the operation information detected by the detection unit, and wherein the controller controls whether the AC voltage is to be applied to the charging member by the voltage application device on the basis of the use environment information detected by the environment detection unit.

2. The image forming apparatus according to claim 1, wherein the operation information of the image forming apparatus is information related to a moving distance of a surface of the image bearing member in association with a rotation of the image bearing member in the image forming operation carried out before the non-image-forming operation.

3. The image forming apparatus according to claim 2, wherein the controller controls so as to increase the duration for which the AC voltage is applied as a moving distance of a surface of the image bearing member in association with a rotation of the image bearing member in the image forming operation carried out before the non-image-forming operation is longer.

4. The image forming apparatus according to claim 1, wherein the operation information of the image forming apparatus is operation information of the developing device in the image forming operation carried out before the non-image-forming operation.

5. The image forming apparatus according to claim 1, wherein the controller controls whether the AC voltage is to be applied to the charging member by the voltage application device in a case in which the detection unit has detected an irregular stop of the image forming apparatus.

6. The image forming apparatus according to claim 1, wherein a potential of the image bearing member is changed by a unit other than the charging member during a period in which the AC voltage is applied to the charging member by the voltage application device during the non-image-forming operation of the image forming apparatus.

7. The image forming apparatus according to claim 6, wherein the potential of the image bearing member before the image bearing member is charged by the charging member is controlled by the transfer member.

8. The image forming apparatus according to claim 7, wherein a transfer voltage applied to the transfer member is changed during a period in which the AC voltage is applied to the charging member by the voltage application device during the non-image-forming operation of the image forming apparatus.

9. The image forming apparatus according to claim 1, wherein a plurality of process cartridges are provided in the image forming apparatus, and a method of counting a moving distance of the image bearing member is varied among the process cartridges.

10. The image forming apparatus according to claim 1, wherein a plurality of process cartridges are provided in the image forming apparatus, and a threshold value for a moving distance of the image bearing member is varied among the process cartridges.

11. An image forming apparatus configured to carry out an image forming operation of forming an image on a recording material, the image forming apparatus comprising:

an image bearing member configured to be rotatable;

a charging member configured to charge the image bearing member;

a voltage application device configured to apply a voltage to the charging member;

an image exposure device configured to form an electrostatic latent image on the image bearing member charged by the charging member;

a developing device configured to supply developer to the electrostatic latent image formed on the image bearing member by the image exposure device so as to develop the electrostatic latent image into a toner image;

a transfer member configured to transfer the toner image formed on the image bearing member by the developing device onto a transfer body;

a detection unit configured to detect operation information of the image forming apparatus; and a controller configured to cause the voltage application device to apply an AC voltage to the charging member during a non-image-forming operation of the image forming apparatus, wherein the controller is configured to control a duration for which the AC voltage is applied on the basis of the operation information detected by the detection unit, and wherein the operation information of the image forming apparatus is operation information of the developing device in the image forming operation carried out before the non-image-forming operation.

12. The image forming apparatus according to claim 11, wherein the operation information of the image forming apparatus is information related to a moving distance of a surface of the image bearing member in association with a rotation of the image bearing member in the image forming operation carried out before the non-image-forming operation.

13. The image forming apparatus according to claim 12, wherein the controller controls so as to increase the duration for which the AC voltage is applied as a moving distance of a surface of the image bearing member in association with a rotation of the image bearing member in the image forming operation carried out before the non-image-forming operation is longer.

14. An image forming apparatus configured to carry out an image forming operation of forming an image on a recording material, the image forming apparatus comprising:

an image bearing member configured to be rotatable;

a charging member configured to charge the image bearing member;

a voltage application device configured to apply a voltage to the charging member;

an image exposure device configured to form an electrostatic latent image on the image bearing member charged by the charging member;

a developing device configured to supply developer to the electrostatic latent image formed on the image bearing member by the image exposure device so as to develop the electrostatic latent image into a toner image;

a transfer member configured to transfer the toner image formed on the image bearing member by the developing device onto a transfer body;

a detection unit configured to detect operation information of the image forming apparatus; and a controller configured to cause the voltage application device to apply an AC voltage to the charging member during a non-image-forming operation of the image forming apparatus, wherein the controller is configured to control a duration for which the AC voltage is applied on the basis of the operation information detected by the detection unit, and wherein the controller controls whether the AC voltage is to be applied to the charging member by the voltage application device in a case in which the detection unit has detected an irregular stop of the image forming apparatus.

15. The image forming apparatus according to claim 14, wherein the operation information of the image forming apparatus is information related to a moving distance of a surface of the image bearing member in association with a rotation of the image bearing member in the image forming operation carried out before the non-image-forming operation.

16. The image forming apparatus according to claim 15, wherein the controller controls so as to increase the duration for which the AC voltage is applied as a moving distance of a surface of the image bearing member in association with a rotation of the image bearing member in the image forming operation carried out before the non-image-forming operation is longer.

17. An image forming apparatus configured to carry out an image forming operation of forming an image on a recording material, the image forming apparatus comprising:

an image bearing member configured to be rotatable;

a charging member configured to charge the image bearing member;

a voltage application device configured to apply a voltage to the charging member;

an image exposure device configured to form an electrostatic latent image on the image bearing member charged by the charging member;

a developing device configured to supply developer to the electrostatic latent image formed on the image bearing member by the image exposure device so as to develop the electrostatic latent image into a toner image;

a transfer member configured to transfer the toner image formed on the image bearing member by the developing device onto a transfer body;

a detection unit configured to detect operation information of the image forming apparatus; and a controller configured to cause the voltage application device to apply an AC voltage to the charging member during a non-image-forming operation of the image forming apparatus, wherein the controller is configured to control a duration for which the AC voltage is applied on the basis of the operation information detected by the detection unit, and wherein a potential of the image bearing member is changed by a unit other than the charging member during a period in which the AC voltage is applied to the charging member by the voltage application device during the non-image-forming operation of the image forming apparatus.

18. The image forming apparatus according to claim 17, wherein the operation information of the image forming apparatus is information related to a moving distance of a surface of the image bearing member in association with a rotation of the image bearing member in the image forming operation carried out before the non-image-forming operation.

19. The image forming apparatus according to claim 18, wherein the controller controls so as to increase the duration for which the AC voltage is applied as a moving distance of a surface of the image bearing member in association with a rotation of the image bearing member in the image forming operation carried out before the non-image-forming operation is longer.

* * * * *